US012571186B2

(12) United States Patent
Konda et al.

(10) Patent No.: US 12,571,186 B2
(45) Date of Patent: Mar. 10, 2026

(54) CALIBRATION DEVICE AND CALIBRATION METHOD

(71) Applicant: KOMATSU LTD., Tokyo (JP)

(72) Inventors: Tomoki Konda, Tokyo (JP); Ryuta Okuwaki, Tokyo (JP)

(73) Assignee: KOMATSU LTD., Tokyo (JP)

( * ) Notice: Subject to any disclaimer, the term of this patent is extended or adjusted under 35 U.S.C. 154(b) by 484 days.

(21) Appl. No.: 18/001,330

(22) PCT Filed: Jun. 17, 2021

(86) PCT No.: PCT/JP2021/022997
§ 371 (c)(1),
(2) Date: Dec. 9, 2022

(87) PCT Pub. No.: WO2021/256528
PCT Pub. Date: Dec. 23, 2021

(65) Prior Publication Data

US 2023/0250617 A1 Aug. 10, 2023

(30) Foreign Application Priority Data

Jun. 19, 2020 (JP) ..... 2020-106401

(51) Int. Cl.
*E02F 9/26* (2006.01)

(52) U.S. Cl.
CPC ..... *E02F 9/264* (2013.01)

(58) Field of Classification Search
CPC ..... E02F 9/264
USPC ..... 702/97
See application file for complete search history.

(56) References Cited

U.S. PATENT DOCUMENTS

2013/0158788 A1 6/2013 Seki
2013/0158789 A1* 6/2013 Seki ..... G01S 19/23 701/34.4
2017/0089041 A1 3/2017 Kawamoto et al.
2017/0284071 A1 10/2017 Yamaguchi et al.
2019/0136467 A1* 5/2019 Laugwitz ..... E01C 23/01
2021/0011122 A1 1/2021 Tanaka et al.
2021/0100156 A1* 4/2021 Iwase ..... G01S 17/931
(Continued)

FOREIGN PATENT DOCUMENTS

CN 103080427 A 5/2013
CN 106817905 A 6/2017
(Continued)

*Primary Examiner* — Aditya S Bhat
(74) *Attorney, Agent, or Firm* — Spencer Fane LLP

(57) ABSTRACT

A distance acquisition unit acquires first distance data that is distance data in an area in which a first reference object installed at an arbitrary position outside a work machine is present. The distance data is measured by an in-vehicle distance sensor. A position calculation unit calculates a position of the first reference object in a predetermined coordinate system based on the first distance data. A relationship acquisition unit acquires a positional relationship between the first reference object, and a second reference object of which a position in the coordinate system is known. A calibration unit calibrates, based on the first distance data and the positional relationship, a parameter to be used to measure a position in the coordinate system from the distance data of the in-vehicle distance sensor.

13 Claims, 10 Drawing Sheets

(56) References Cited

U.S. PATENT DOCUMENTS

| | | | |
|---|---|---|---|
| 2021/0209800 | A1 | 7/2021 | Atsumi et al. |
| 2022/0026587 | A1 | 1/2022 | Hayakawa et al. |

FOREIGN PATENT DOCUMENTS

| | | | |
|---|---|---|---|
| CN | 111243029 | A | 6/2020 |
| JP | 2009014481 | A | 1/2009 |
| JP | 2010032339 | A | 2/2010 |
| JP | 2012-202061 | A | 10/2012 |
| JP | 2019-143995 | A | 8/2019 |
| JP | 2020-20656 | A | 2/2020 |
| JP | 2020-45687 | A | 3/2020 |
| JP | 2020-51029 | A | 4/2020 |
| WO | 2016/148309 | A1 | 9/2016 |
| WO | 2018/164079 | A1 | 9/2018 |
| WO | 2019/187937 | A1 | 10/2019 |
| WO | 2020/003497 | A1 | 1/2020 |

* cited by examiner

CALIBRATION DEVICE AND CALIBRATION METHOD

CROSS-REFERENCE TO RELATED APPLICATIONS

This application is a U.S. National stage application of International Application No. PCT/JP2021/022997, filed on Jun. 17, 2021. This U.S. National stage application claims priority under 35 U.S.C. § 119(a) to Japanese Patent Application No. 2020-106401, filed in Japan on Jun. 19, 2020, the entire contents of which are hereby incorporated herein by reference.

TECHNICAL FIELD

The present disclosure relates to a calibration device and a calibration method that calibrate an in-vehicle distance sensor provided in a work machine.

BACKGROUND INFORMATION

PCT International Publication No. WO2016/148309 discloses a technique of calibrating a distance sensor in a work machine including a work tool and an imaging device. Specifically, in a calibration system disclosed in PCT International Publication No. WO2016/148309, the distance sensor measures a distance of a target provided in the work tool, a positional relationship between the distance sensor and the target is obtained from an image, and the distance sensor is calibrated based on a posture of the work tool and the positional relationship obtained from distance data.

SUMMARY

The distance sensor provided in the work machine is not always provided to face the front from the work machine. For example, the distance sensor may be provided on a side surface of the work machine. In this case, since the work tool is not present in a measurement area of the distance sensor, the calibration method disclosed in PCT International Publication No. WO2016/148309 cannot be performed. In addition, all work machines are not always provided with the work tool. Even in this case, the calibration method disclosed in PCT International Publication No. WO2016/148309 cannot be performed.

An object of the present disclosure is to provide a calibration device and a calibration method capable of calibrating a distance sensor regardless of whether or not a work tool appears in a measurement area of the distance sensor.

According to an aspect of the present disclosure, a calibration device, which calibrates an in-vehicle distance sensor provided in a work machine, includes: a distance acquisition unit that acquires first distance data that is distance data in an area in which a first reference object installed at an arbitrary position outside the work machine is present, the distance data being measured by the in-vehicle distance sensor; a position calculation unit that calculates a position of the first reference object in a predetermined coordinate system based on the first distance data; a relationship acquisition unit that acquires a positional relationship between the first reference object, and a second reference object of which a position in the coordinate system is known; and a calibration unit that calibrates, based on the first distance data and the positional relationship, a parameter to be used to measure a position in the coordinate system from the distance data of the in-vehicle distance sensor.

According to the aspect described above, the calibration device can calibrate the distance sensor regardless of whether or not the work tool appears in the measurement area of the distance sensor.

DESCRIPTION OF EMBODIMENTS

Coordinate System

Figure 1:
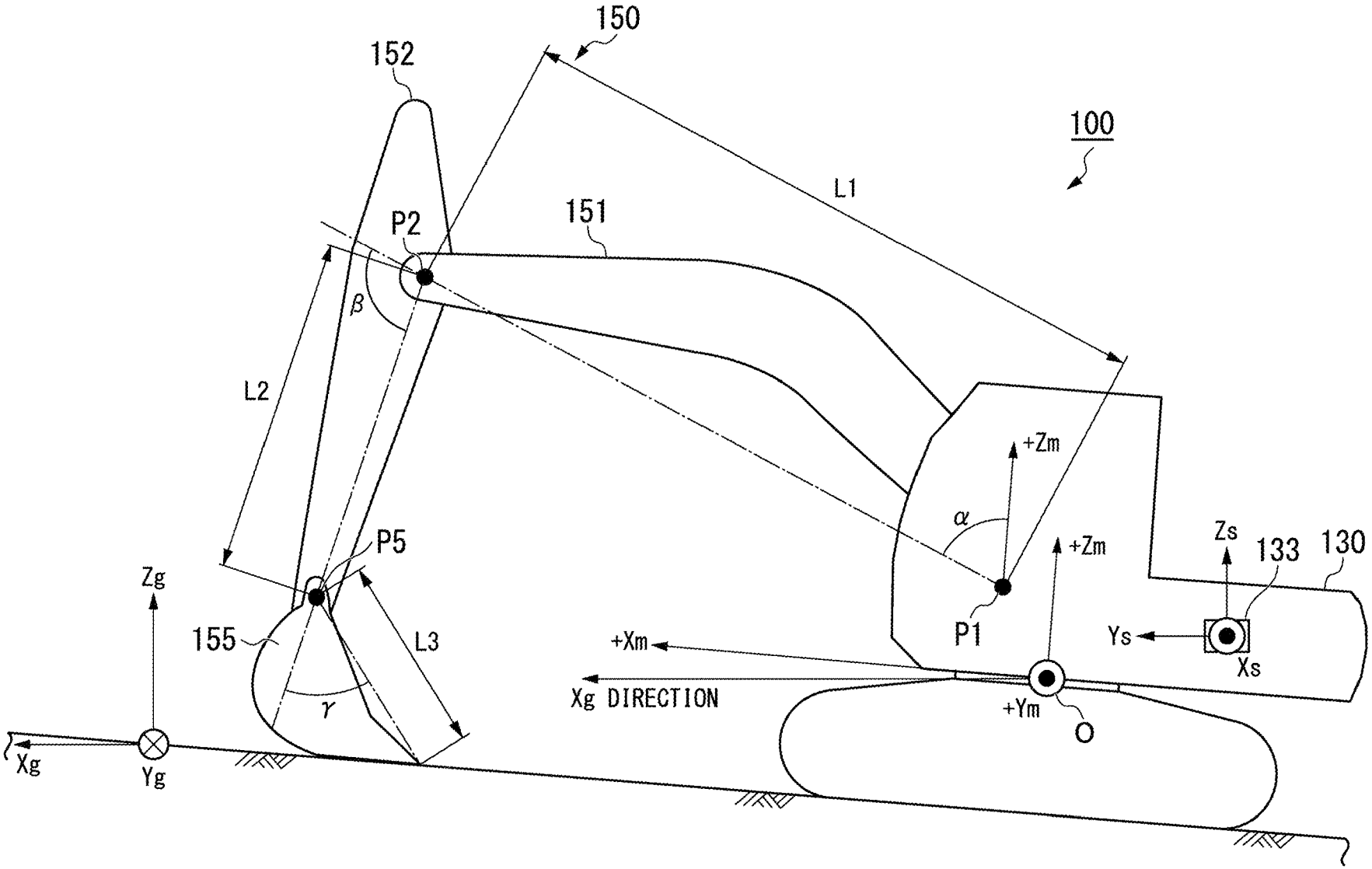
FIG. 1 is a diagram showing an example of a posture of a work machine.

FIG. 1 is a diagram showing an example of a posture of a work machine 100. In the following description, a three-dimensional site coordinate system (Xg, Yg, Zg), a three-dimensional vehicle body coordinate system (Xm, Ym, Zm), and a three-dimensional sensor coordinate system (Xs, Ys, Zs) are defined, and the positional relationship will be described based on these.

The site coordinate system is a coordinate system configured by an Xg axis extending to north and south, a Yg axis extending to east and west, and a Zg axis extending in a vertical direction, with a position of a global navigation satellite system (GNSS) reference station provided at a construction site as a reference point. Exemplary examples of the GNSS include a global positioning system (GPS). It should be noted that, in another embodiment, a global coordinate system represented by latitude and longitude may be used instead of the site coordinate system.

The vehicle body coordinate system is a coordinate system configured by, as viewed from a seating position of an operator in a cab 170 described later, an Xm axis extending back and forth, a Ym axis extending left and right, and a Zm axis extending up and down, with a representative point 0 defined for a swiveling body 130 of the work machine 100 as a reference. With the representative point 0 of the swiveling body 130 as a reference, a front side is referred to as a +Xm direction, a rear side is referred to as a −Xm direction, a left side is referred to as a +Ym direction, a right side is referred to as a −Ym direction, an upward direction is referred to as a +Zm direction, and a downward direction is referred to as a −Zm direction.

The site coordinate system and the vehicle body coordinate system can be transformed into each other by specifying a position and an inclination of the work machine 100 in the site coordinate system.

The sensor coordinate system is a coordinate system configured by an Xs axis extending in a measurement direction of a distance sensor, a Ys axis extending left and right, and a Zs axis extending up and down, with a position of the distance sensor provided in the work machine 100 as a reference.

Since the distance sensor is fixed to a vehicle body, the sensor vehicle body coordinate system and the sensor coordinate system can be transformed into each other in a case in which an installation position of the distance sensor in the vehicle body is known.

First Embodiment

Configuration of Work Machine 100

Figure 2:
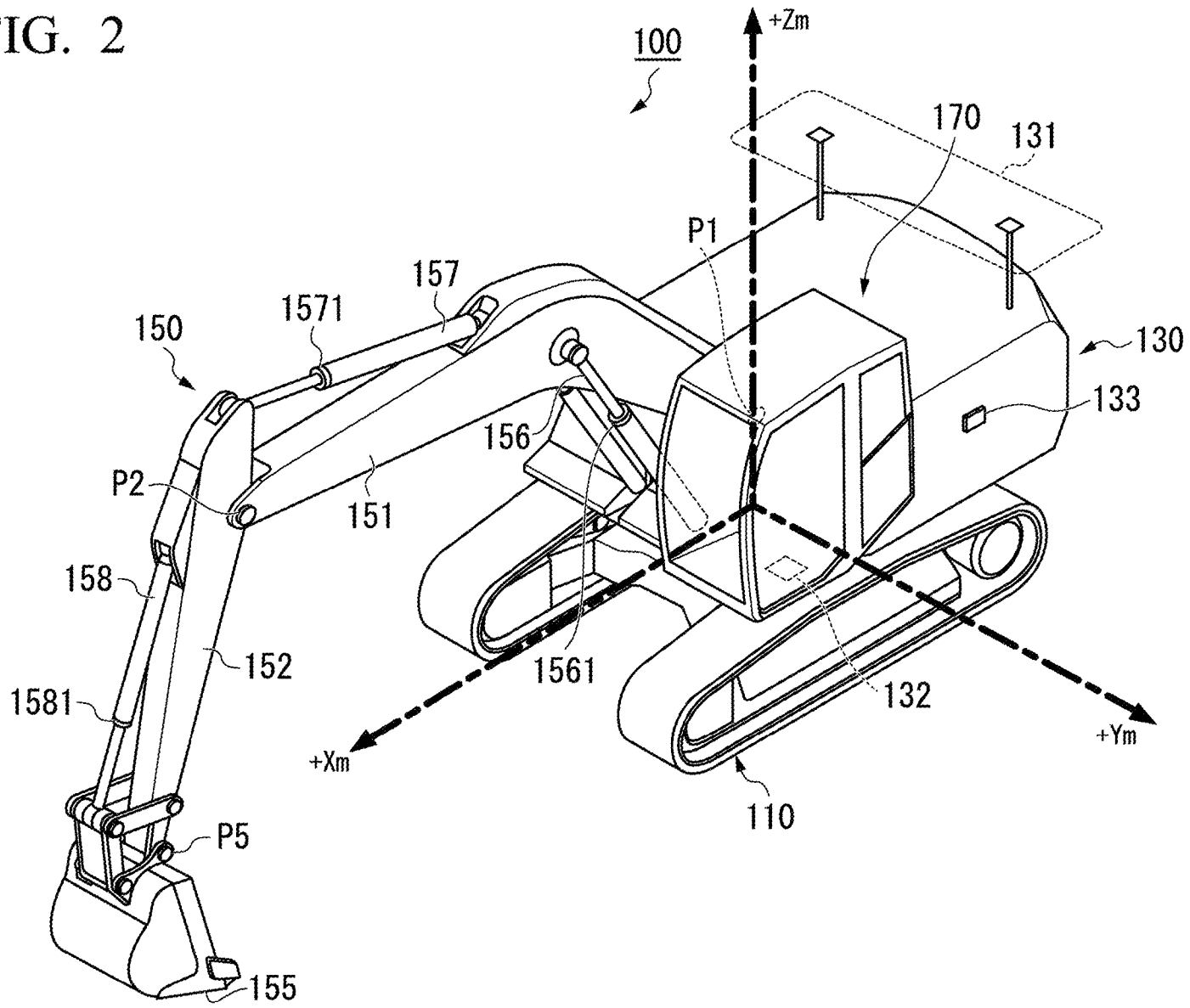
FIG. 2 is a schematic diagram showing a configuration of the work machine according to a first embodiment.

FIG. 2 is a schematic diagram showing a configuration of the work machine 100 according to a first embodiment.

The work machine 100 is operated at a construction site and constructs an excavation target, such as earth. The work machine 100 according to the first embodiment is a hydraulic excavator.

The work machine 100 includes an undercarriage 110, the swiveling body 130, a work tool 150, and the cab 170.

The undercarriage 110 supports the work machine 100 to be able to travel. The undercarriage 110 is, for example, a pair of left and right continuous tracks. The swiveling body 130 is supported by the undercarriage 110 to be able to swivel around a swiveling center. The work tool 150 is driven by hydraulic pressure. The work tool 150 is supported by a front portion of the swiveling body 130 to be able to be driven in an up-down direction. The cab 170 is a space in which the operator gets on and performs an operation of the work machine 100. The cab 170 is provided in the front portion of the swiveling body 130.

Configuration of Swiveling Body 130

As shown in FIG. 2, the swiveling body 130 includes a position/azimuth direction detector 131, an inclination detector 132, and a distance sensor 133.

The position/azimuth direction detector 131 calculates a position of the swiveling body 130 in the site coordinate system and an azimuth direction in which the swiveling body 130 faces. The position/azimuth direction detector 131 includes two antennas that receive positioning signals from artificial satellites constituting the GNSS. The two antennas are installed at different positions on the swiveling body 130. For example, the two antennas are provided in a counterweight portion of the swiveling body 130. The position/azimuth direction detector 131 detects a position of the representative point O of the swiveling body 130 in the site coordinate system based on the positioning signal received by at least one of the two antennas. The position/azimuth direction detector 131 detects the azimuth direction of the swiveling body 130 in the site coordinate system by using the positioning signal received by each of the two antennas.

The inclination detector 132 measures the acceleration and angular velocity of the swiveling body 130, and detects the inclination of the swiveling body 130 (for example, a roll representing rotation with respect to the Xm axis and a pitch representing rotation with respect to the Ym axis) based on the measurement results. The inclination detector 132 is installed, for example, below the cab 170. Exemplary examples of the inclination detector 132 include an inertial measurement unit (IMU).

The distance sensor 133 is provided in the swiveling body 130 and detects the distance to a target object in a measurement area. The distance sensors 133 are provided on both side surfaces of the swiveling body 130, and detect the distance of surroundings including a construction target in the measurement area about the axis (Xs axis) extending in a width direction of the swiveling body 130. As a result, when the work machine 100 excavates the earth by the work tool 150, the distance sensor 133 can detect the distance of a transport vehicle (not shown), which is stopped on the side of the work machine 100 and is a target onto which the earth is loaded. In addition, when the work machine 100 loads the earth onto the transport vehicle, the distance sensor 133 can detect the distance of the construction target.

The distance sensor 133 is provided at a position at which the work tool 150 does not interfere with the measurement area thereof. That is, the distance sensor 133 measures the distance in an area in which the work tool 150 does not appear.

Exemplary examples of the distance sensor 133 include a LiDAR device, a radar device, and a stereo camera. The distance sensor 133 may be provided at a position other than the side surface of the swiveling body 130 as long as the work tool 150 does not interfere with the measurement area. For example, the distance sensor 133 may be provided at a position on an upper portion of the swiveling body 130 and at a position at which the distance on the side of the vehicle body can be detected. In addition, the distance sensor 133 may be provided only on one side surface of the swiveling body 130.

The distance sensor 133 is detachably provided on the swiveling body 130. The distance sensor 133 is an example of an in-vehicle distance sensor.

Configuration of Work Tool 150

As shown in FIG. 2, the work tool 150 includes a boom 151, an arm 152, and a bucket 155.

A base end portion of the boom 151 is attached to the swiveling body 130 via a boom pin P1. The arm 152 connects the boom 151 and the bucket 155. A base end portion of the arm 152 is attached to a distal end portion of the boom 151 via an arm pin P2.

The bucket 155 includes teeth for excavating the earth and an accommodation portion for accommodating the excavated earth. A base end portion of the bucket 155 is attached to a distal end portion of the arm 152 via a bucket pin P5.

The work tool 150 includes a plurality of hydraulic cylinders that are actuators for generating power. Specifically, the work tool 150 includes a boom cylinder 156, an arm cylinder 157, and a bucket cylinder 158.

The boom cylinder 156 is a hydraulic cylinder for operating the boom 151. A base end portion of the boom cylinder 156 is attached to the swiveling body 130. A distal end portion of the boom cylinder 156 is attached to the boom 151. The boom cylinder 156 is provided with a boom cylinder stroke sensor 1561 that detects a stroke amount of the boom cylinder 156.

The arm cylinder 157 is a hydraulic cylinder for driving the arm 152. A base end portion of the arm cylinder 157 is attached to the boom 151. A distal end portion of the arm cylinder 157 is attached to the arm 152. The arm cylinder 157 is provided with an arm cylinder stroke sensor 1571 that detects a stroke amount of the arm cylinder 157. The bucket cylinder 158 is a hydraulic cylinder for driving the bucket 155. A base end portion of the bucket cylinder 158 is attached to the arm 152. A distal end portion of the bucket cylinder 158 is attached to the bucket 155. The bucket cylinder 158 is provided with a bucket cylinder stroke sensor 1581 that detects a stroke amount of the bucket cylinder 158.

Configuration of Cab 170

Figure 3:
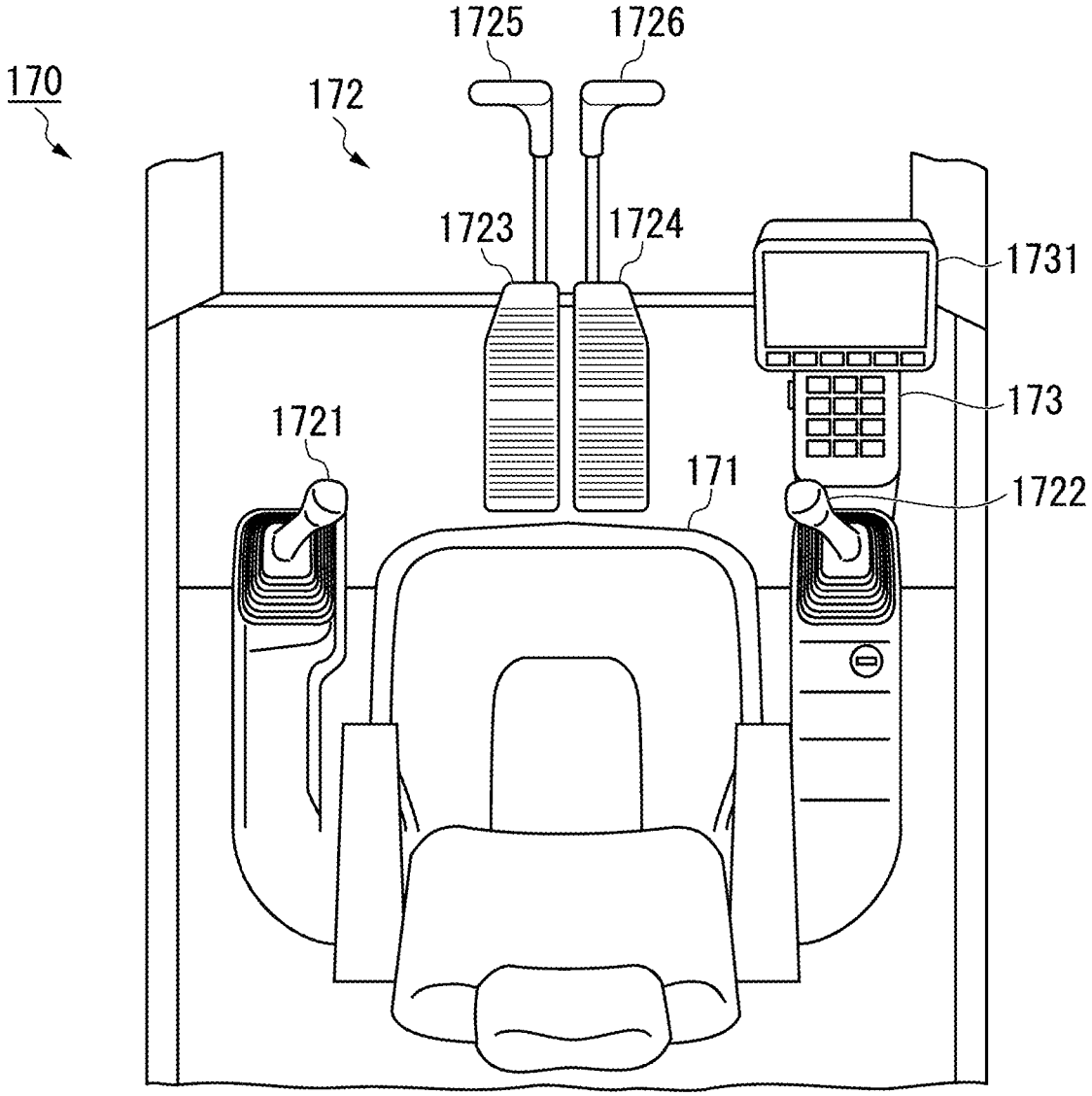
FIG. 3 is a diagram showing an internal configuration of a cab according to the first embodiment.

FIG. 3 is a diagram showing an internal configuration of the cab according to the first embodiment.

As shown in FIG. 3, a driver's seat 171, an operation device 172, and a control device 173 are provided in the cab 170.

The operation device 172 is an interface for driving the undercarriage 110, the swiveling body 130, and the work tool 150 by a manual operation of the operator. The operation device 172 includes a left operation lever 1721, a right operation lever 1722, a left foot pedal 1723, a right foot pedal 1724, a left travel lever 1725, and a right travel lever 1726.

The left operation lever 1721 is provided on a left side of the driver's seat 171. The right operation lever 1722 is provided on a right side of the driver's seat 171.

The left operation lever 1721 is an operation mechanism for performing a swiveling operation of the swiveling body 130, and a pulling operation and a pushing operation of the arm 152. Specifically, when the operator inclines the left operation lever 1721 forward, the arm cylinder 157 is driven and the pushing operation of the arm 152 is performed. In addition, when the operator inclines the left operation lever 1721 backward, the arm cylinder 157 is driven and the pulling operation of the arm 152 is performed. In addition, when the operator inclines the left operation lever 1721 in a right direction, the swiveling body 130 swivels to the right. In addition, when the operator inclines the left operation lever 1721 in a left direction, the swiveling body 130 swivels to the left.

The right operation lever 1722 is an operation mechanism for performing an excavation operation and a dump operation of the bucket 155, and a lifting operation and a lowering operation of the boom 151. Specifically, when the operator inclines the right operation lever 1722 forward, the boom cylinder 156 is driven and the lowering operation of the boom 151 is performed. In addition, when the operator inclines the right operation lever 1722 backward, the boom cylinder 156 is driven and the lifting operation of the boom 151 is performed. In addition, when the operator inclines the right operation lever 1722 in the right direction, the bucket cylinder 158 is driven and the dump operation of the bucket 155 is performed. In addition, when the operator inclines the right operation lever 1722 in the left direction, the bucket cylinder 158 is driven and the excavation operation of the bucket 155 is performed. It should be noted that a relationship between operation directions of the left operation lever 1721 and the right operation lever 1722, the operation direction of the work tool 150, and the swiveling direction of the swiveling body 130 does not have to be the relationship described above.

The left foot pedal 1723 is disposed on a left side of a floor surface in front of the driver's seat 171. The right foot pedal 1724 is disposed on a right side of the floor surface in front of the driver's seat 171. The left travel lever 1725 is pivotally supported by the left foot pedal 1723, and is configured such that the inclination of the left travel lever 1725 and the push-down of the left foot pedal 1723 are interlocked with each other. The right travel lever 1726 is pivotally supported by the right foot pedal 1724, and is configured such that the inclination of the right travel lever 1726 and the push-down of the right foot pedal 1724 are interlocked with each other.

The left foot pedal 1723 and the left travel lever 1725 correspond to the rotational drive of a left crawler belt of the undercarriage 110. Specifically, in a case in which a drive wheel of the undercarriage 110 is backward, when the operator inclines the left foot pedal 1723 or the left travel lever 1725 forward, the left crawler belt is rotated in a forward direction. In addition, when the operator inclines the left foot pedal 1723 or the left travel lever 1725 backward, the left crawler belt is rotated in a reverse direction.

The right foot pedal 1724 and the right travel lever 1726 correspond to the rotational drive of a right crawler belt of the undercarriage 110. Specifically, in a case in which the drive wheel of the undercarriage 110 is backward, when the operator inclines the right foot pedal 1724 or the right travel lever 1726 forward, the right crawler belt is rotated in the forward direction. In addition, when the operator inclines the right foot pedal 1724 or the right travel lever 1726 backward, the right crawler belt is rotated in the reverse direction.

The control device 173 controls the undercarriage 110, the swiveling body 130, and the work tool 150 based on the operation of the operator. The control device 173 includes a display 1731 that is an input/output device and that displays information related to a plurality of functions of the work machine 100. The control device 173 is an example of a calibration device. Input means of the control device 173 according to the first embodiment is a hard key. It should be noted that, in another embodiment, a touch panel, a mouse, a keyboard, or the like may be used as the input means. In addition, the control device 173 according to the first embodiment is provided integrally with the display 1731, but the display 1731 may be provided separately from the control device 173 in another embodiment.

Configuration of Control Device 173

Figure 4:
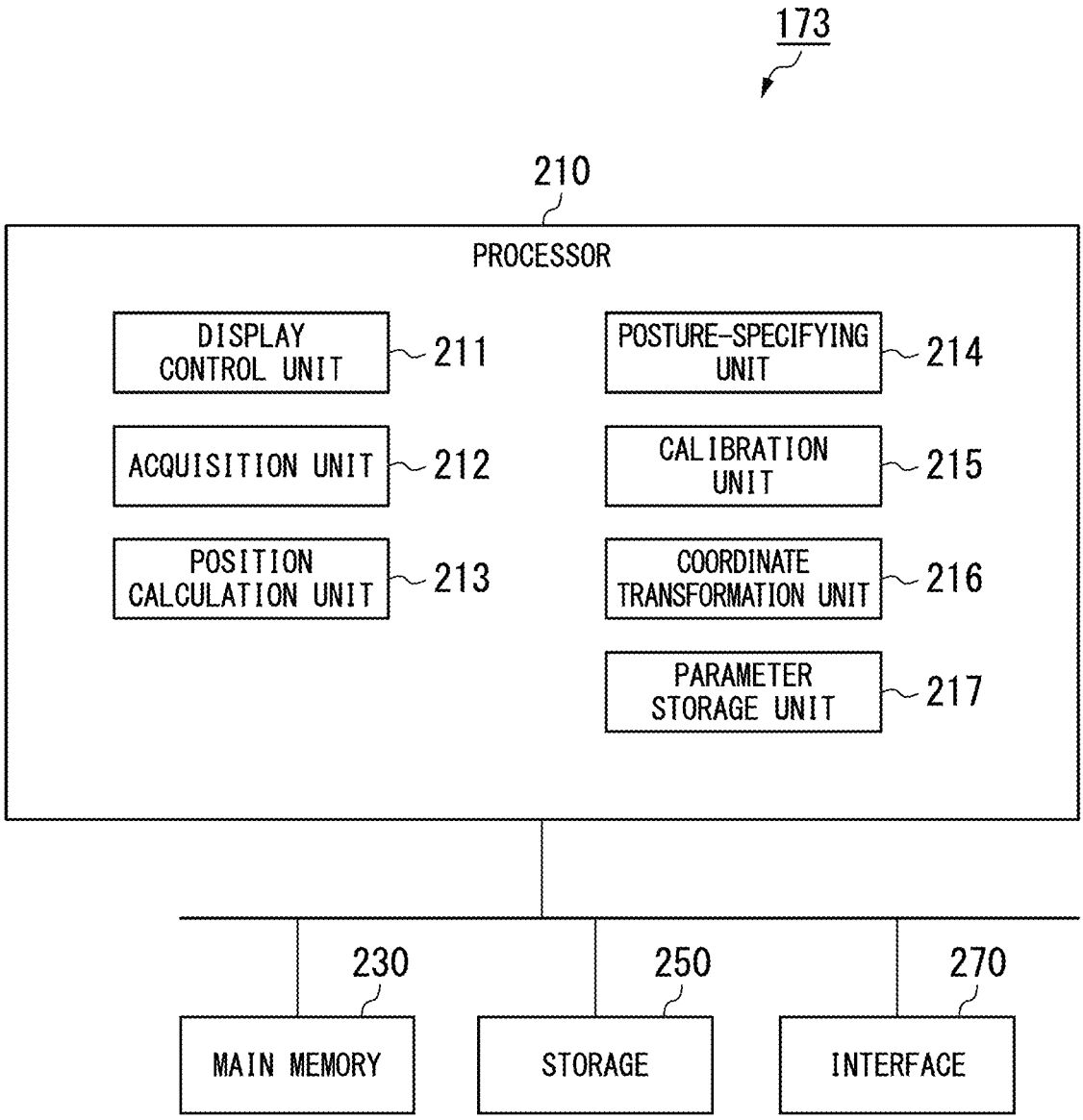
FIG. 4 is a schematic block diagram showing a configuration of a computer according to the first embodiment.

FIG. 4 is a schematic block diagram showing a configuration of a computer according to the first embodiment.

The control device 173 is a computer that includes a processor 210, a main memory 230, a storage 250, and an interface 270.

The display 1731 is connected to the processor 210 via the interface 270.

The storage 250 is a non-transitory tangible storage medium. Exemplary examples of the storage 250 include a magnetic disk, a magneto-optical disk, an optical disk, and a semiconductor memory. The storage 250 may be an internal medium directly connected to a bus of the control device 173, or may be an external medium connected to the control device 173 via the interface 270 or a communication line. The storage 250 stores a calibration program for calibrating the distance sensor 133.

The calibration program may be a program for realizing some of the functions exerted by the control device 173. For example, the calibration program may be a program for exerting the functions in combination with another program already stored in the storage 250, or in combination with another program implemented on another device. It should be noted that, in another embodiment, the control device 173 may include a custom large-scale integrated circuit (LSI), such as a programmable logic device (PLD), in addition to the configuration described above or instead of the configuration described above. Exemplary examples of the PLD include a programmable array logic (PAL), a generic array logic (GAL), a complex programmable logic device (CPLD), and a field-programmable gate array (FPGA). In this case, part or all of the functions realized by the processor 210 may be realized by the above integrated circuit.

The processor 210 carries out the calibration program to function as a display control unit 211, an acquisition unit 212, a position calculation unit 213, a posture-specifying unit 214, a calibration unit 215, a coordinate transformation unit 216, and a parameter storage unit 217.

The display control unit 211 generates screen data to be displayed on the display 1731, and outputs the screen data to the display 1731.

The acquisition unit 212 acquires measurement data from various sensors. Specifically, the acquisition unit 212 acquires the measurement data of the position/azimuth direction detector 131, the inclination detector 132, the distance sensor 133, the boom cylinder stroke sensor 1561, the arm cylinder stroke sensor 1571, and the bucket cylinder stroke sensor 1581.

The position calculation unit 213 calculates a position of a marker M to be used to calibrate the distance sensor 133 in the sensor coordinate system based on the measurement data (hereinafter referred to as distance data) of the distance sensor 133 acquired by the acquisition unit 212. A reflective material having a predetermined reflectance can be used as the marker M. As a result, the position calculation unit 213 can specify the position of the marker M by searching for a portion having the predetermined reflectance in the measurement data of the distance sensor 133.

The posture-specifying unit 214 specifies the position of the teeth of the bucket 155 in the vehicle body coordinate system based on the measurement data of the boom cylinder stroke sensor 1561, the arm cylinder stroke sensor 1571, and the bucket cylinder stroke sensor 1581 acquired by the acquisition unit 212. Hereinafter, a specifying method of the position of the teeth of the bucket 155 by the posture-specifying unit 214 will be described with reference to FIG. 1. First, the posture-specifying unit 214 calculates an inclination angle β of the boom 151 from the measurement data of the boom cylinder stroke sensor 1561. The posture-specifying unit 214 specifies a position of the arm pin P2 in the vehicle body coordinate system based on the calculated inclination angle α, a known position of the boom pin P1 in the vehicle body coordinate system, and a known length L1 of the boom 151. The posture-specifying unit 214 calculates an inclination angle β of the arm 152 from the measurement data of the arm cylinder stroke sensor 1571. The posture-specifying unit 214 specifies a position of the bucket pin P5 in the vehicle body coordinate system based on the calculated inclination angle β, the position in the vehicle body coordinate system of the arm pin P2, and a known length L2 of the arm 152. The posture-specifying unit 214 calculates an inclination angle γ of the bucket 155 from the measurement data of the bucket cylinder stroke sensor 1581. The posture-specifying unit 214 specifies the position of the teeth of the bucket 155 in the vehicle body coordinate system based on the calculated inclination angle γ, the position in the vehicle body coordinate system of the bucket pin P5, and a known length L3 of the bucket 155.

The calibration unit 215 calculates a parameter to be used to mutually transform a position in the sensor coordinate system and a position in the vehicle body coordinate system based on the position of the marker M and the position of the teeth of the bucket 155. The calibration unit 215 stores the calculated parameter in the parameter storage unit 217. Exemplary examples of the parameter include a position and an inclination (external parameters) of the distance sensor 133 in the work machine 100.

The coordinate transformation unit 216 mutually transforms the position in the vehicle body coordinate system and the position in the site coordinate system based on the measurement data of the position/azimuth direction detector 131 and the inclination detector 132 acquired by the acquisition unit 212. In addition, the coordinate transformation unit 216 mutually transforms the position in the sensor coordinate system and the position in the vehicle body coordinate system based on the parameter stored in the parameter storage unit 217.

Calibration Method of Distance Sensor

Figure 5:
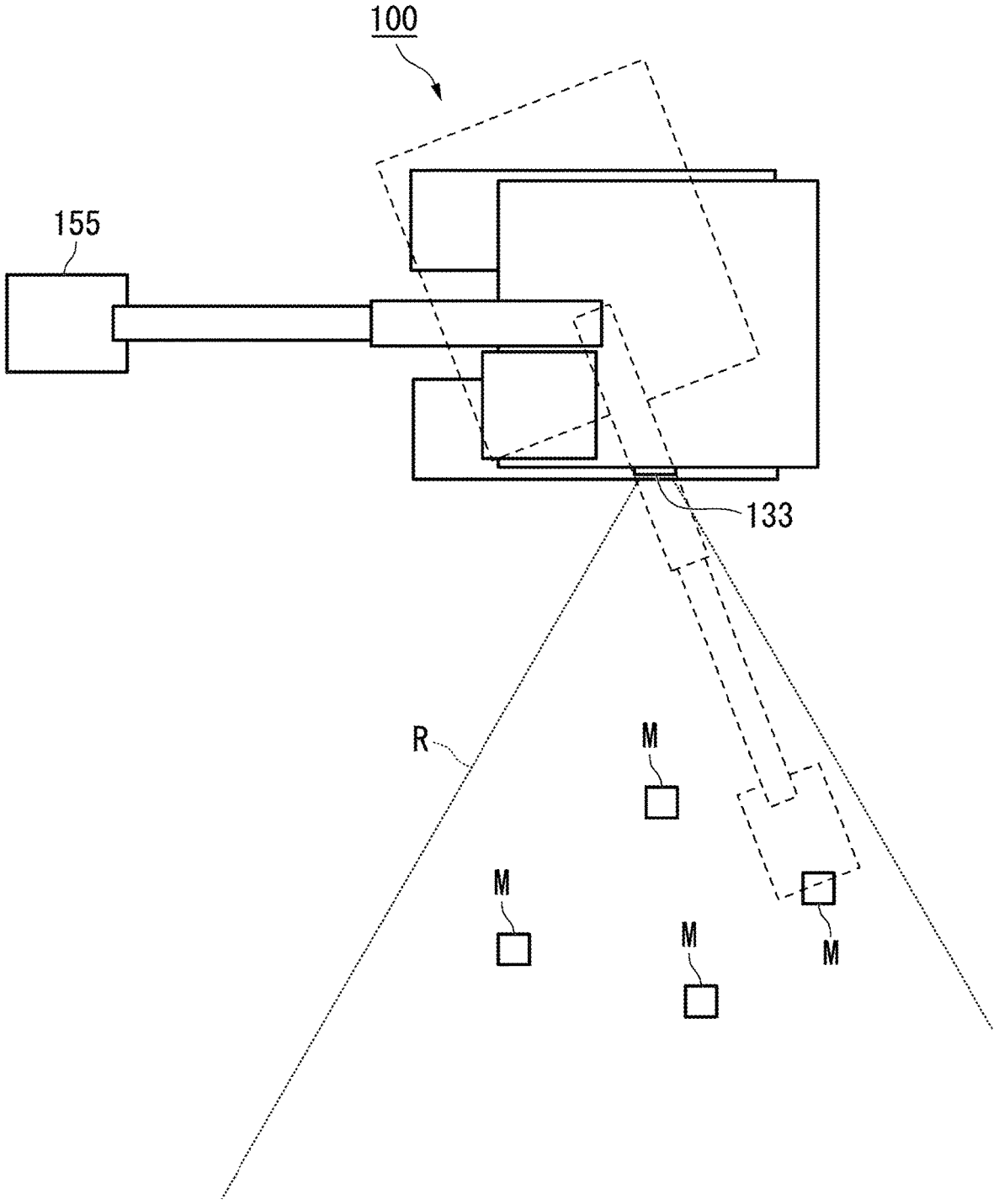
FIG. 5 is a diagram showing an outline of a calibration method of a distance sensor of the work machine according to the first embodiment.

FIG. 5 is a diagram showing an outline of a calibration method of the distance sensor 133 of the work machine 100 according to the first embodiment.

In the first embodiment, a plurality of markers M are installed in a measurement area R of the distance sensor 133 attached to the work machine 100, and the positions of the markers M are measured, and then the operator operates the work machine 100 to bring the teeth of the bucket 155 into contact with the markers M. As a result, the control device 173 of the work machine 100 can calibrate the parameter of the distance sensor 133 such that the position of the marker M measured by the distance sensor 133 and the position of the marker M calculated from the position of the teeth of the bucket 155 correspond to each other. It should be noted that, in another embodiment, the control device 173 may calibrate the parameter of the distance sensor 133 by using only one marker M instead of the plurality of markers M. However, it is preferable to use the plurality of markers M for parameter calibration. By using the positions of the plurality of markers M, the parameter can be calibrated with high accuracy even in a case in which the vehicle body is inclined.

Figure 6:
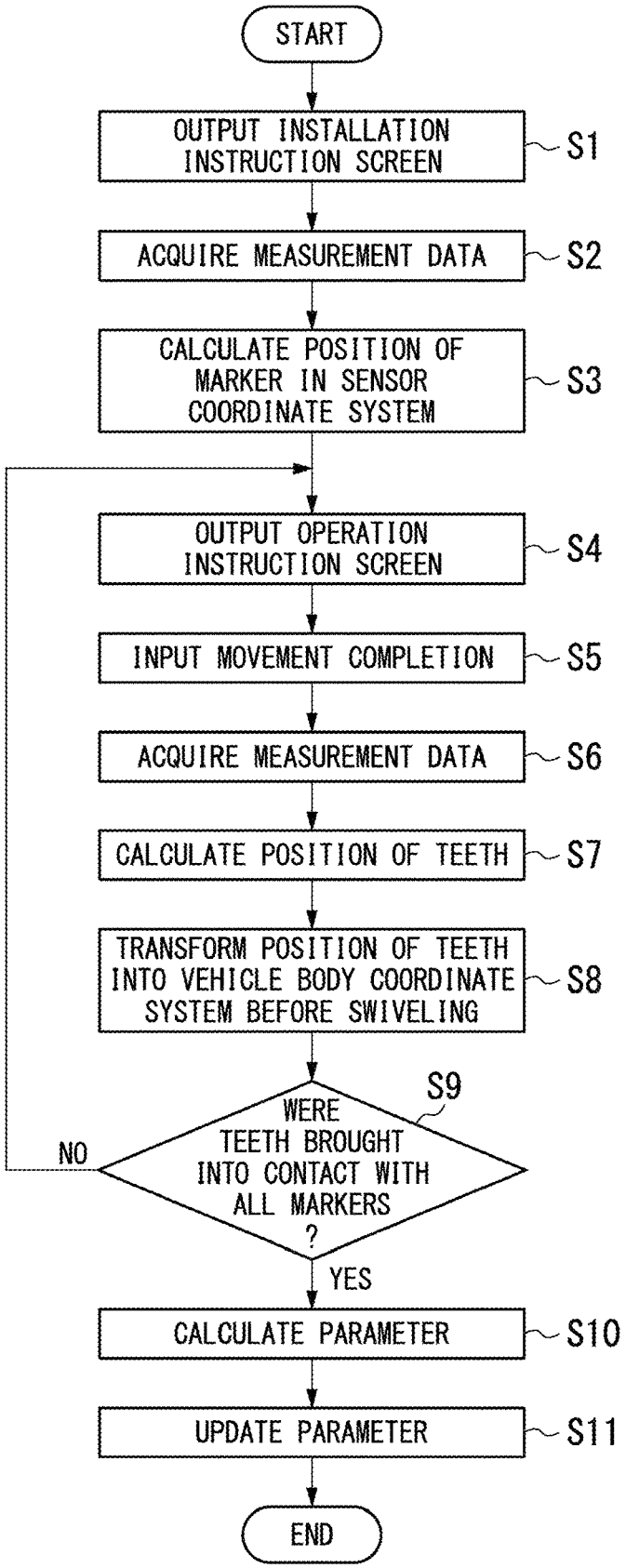
FIG. 6 is a flowchart showing the calibration method of the distance sensor of the work machine according to the first embodiment.

FIG. 6 is a flowchart showing the calibration method of the distance sensor 133 of the work machine 100 according to the first embodiment.

When the operator operates the control device 173 to activate a calibration function of the distance sensor 133, the control device 173 starts a calibration process shown in FIG. 6.

First, the display control unit 211 outputs, to the display 1731, an installation instruction screen prompting the installation of the plurality of markers M in the measurement area R of the distance sensor 133 (step S1). For example, the installation instruction screen includes a guide message, such as "Please install four markers in the measurement area of the distance sensor." In addition, the installation instruction screen may include three-dimensional data indicating a shape of the measurement area R generated based on the measurement data of the distance sensor 133. As a result, the operator can visually recognize the installation instruction screen and determine whether or not the marker M is installed in the measurement area R.

When the operator completes the installation of the marker M, the operator operates the control device 173 and proceeds with the process. Then, the acquisition unit 212 acquires the measurement data from various sensors (step S2). The position calculation unit 213 specifies the position of the marker M in the sensor coordinate system based on the measurement data acquired in step S2 (step S3).

Then, the display control unit 211 outputs, to the display 1731, an operation instruction screen prompting the operation of the work machine 100 for bringing the teeth of the bucket 155 into contact with one of the plurality of markers M (step S4). For example, the operation instruction screen includes a guide message, such as "Please bring the teeth into contact with the marker." In addition, the operation instruction screen may include the three-dimensional data indicating the shape of the measurement area R generated based on the measurement data acquired in step S2.

The operator operates the operation device 172, causes the swiveling body 130 to swivel, drives the work tool 150, and brings the teeth of the bucket 155 into contact with one of the plurality of markers M. When the operator brings the teeth into contact with one of the plurality of markers M, the operator operates the control device 173 and inputs the movement completion of the bucket 155 to the control device 173 (step S5). For example, by touching a portion in which the marker M with which the teeth of the bucket 155 are brought into contact appears among the plurality of markers M included in the three-dimensional data shown in the operation instruction screen, the operator can input the marker M with which the bucket 155 is brought into contact among the plurality of markers M to the control device 173 while inputting the movement completion of the bucket 155.

Then, the acquisition unit 212 acquires the measurement data from various sensors (step S6). The posture-specifying unit 214 specifies the position of the teeth of the bucket 155 in the vehicle body coordinate system based on the measurement data of the boom cylinder stroke sensor 1561, the arm cylinder stroke sensor 1571, and the bucket cylinder stroke sensor 1581 acquired in step S6 (step S7). The position of the teeth of the bucket 155 at this time substantially corresponds to the position of the marker M. That is, the posture-specifying unit 214 is an example of a relationship acquisition unit that acquires a positional relationship between the marker M and the teeth of the bucket 155.

The coordinate transformation unit 216 transforms the position of the teeth of the bucket 155 calculated in step S7 into the position thereof in the site coordinate system at the time of step S2 based on the measurement data of the position/azimuth direction detector 131 and the inclination detector 132 acquired in step S2, and the measurement data of the position/azimuth direction detector 131 and the inclination detector 132 acquired in step S6 (step S8). That is, the coordinate transformation unit 216 calculates change amounts of the position, the swiveling angle, and the inclination by obtaining a difference between the measurement data of the position/azimuth direction detector 131 and the inclination detector 132 acquired in step S2, and the measurement data of the position/azimuth direction detector 131 and the inclination detector 132 acquired in step S7. Then, the coordinate transformation unit 216 can obtain the position in the site coordinate system at the time of step S2 by adjusting the position calculated in step S7 based on the calculated change amounts of the position, the swiveling angle, and the inclination.

The calibration unit 215 determines whether or not the teeth of the bucket 155 have been brought into contact with all of the plurality of markers M (step S9). For example, the calibration unit 215 determines whether or not the input of the movement completion in step S5 has been performed by the number of the markers M designated in step S1. In a case in which there is the marker M with which the teeth of the bucket 155 are not brought into contact (step S9: NO), the control device 173 returns the process to step S4 and outputs the operation instruction screen to the display 1731.

On the other hand, in a case in which the teeth of the bucket 155 have been brought into contact with all of the plurality of markers M (step S9: YES), the calibration unit 215 calculates the parameter of the distance sensor 133 based on the position of the marker in the sensor coordinate system calculated in step S3, and the position of the teeth of the bucket 155 in accordance with each marker M acquired in step S8 (step S10). That is, the position of the teeth of the bucket 155 acquired in step S8 indicates the position of the marker M in the vehicle body coordinate system at the time of step S2. Therefore, the calibration unit 215 can specify the position and the inclination of the distance sensor 133 of the work machine 100 by obtaining and applying a matrix such that all of the plurality of positions of the teeth of the bucket 155 acquired in step S8 overlap the positions of the plurality of markers M calculated in step S3 in one coordinate transformation.

The calibration unit 215 stores the parameter calculated in step S10 in the parameter storage unit 217 (step S11).

As described above, the control device 173 according to the first embodiment calibrates the parameter of the distance sensor as follows.

The acquisition unit 212 acquires distance data in an area in which the marker M installed at an arbitrary position outside the work machine 100 is present, the distance data being measured by the distance sensor 133. The position calculation unit 213 calculates the position of the marker M based on the distance data. The posture-specifying unit 214 acquires the position of the teeth when the teeth of the bucket 155 are brought into contact with the marker M, as the positional relationship between the marker M, and the teeth of the bucket 155 of which the position in the vehicle body coordinate system and the site coordinate system is known. The calibration unit 215 calibrates the parameter for specifying the position and the inclination of the distance sensor 133 in the vehicle body coordinate system based on the position of the teeth when the teeth of the bucket 155 are brought into contact with the marker M, and the position of the marker M measured by the distance sensor 133.

As a result, the control device 173 according to the first embodiment can calibrate the distance sensor 133 that measures the distance in an area in which the work tool 150 does not appear.

Second Embodiment

The control device 173 according to the first embodiment needs to turn the work machine 100 and drive the work tool 150 for calibration of the distance sensor 133. On the other hand, the control device 173 according to a second embodiment calibrates the distance sensor 133 without operating the work machine 100.

Figure 7:
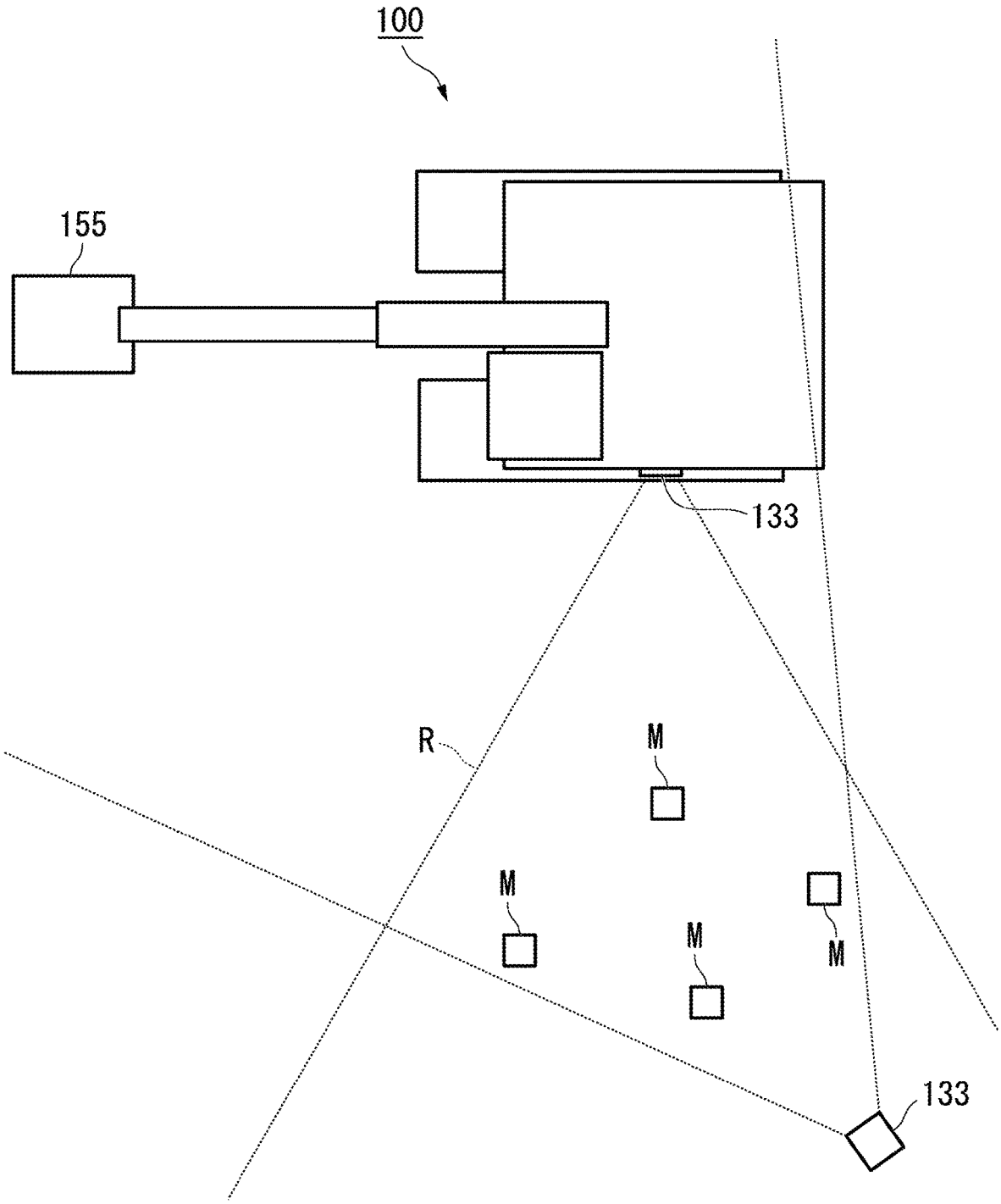
FIG. 7 is a diagram showing an outline of a calibration method of a distance sensor of a work machine according to a second embodiment.

FIG. 7 is a diagram showing an outline of a calibration method of the distance sensor 133 of the work machine 100 according to the second embodiment.

In the second embodiment, the positions of the plurality of markers M and the teeth of the bucket 155 are measured by using the distance sensor 133 detached from the work machine 100, and then the distance sensor 133 is installed in the work machine 100 to measure the position of each marker M again. As a result, the control device 173 of the work machine 100 can constitute the parameter of the distance sensor 133 such that a positional relationship between the marker M and the teeth of the bucket 155 measured by the detached distance sensor 133 corresponds to a relationship between the position of the marker M measured by the attached distance sensor 133 and the position of the teeth of the bucket 155 measured by the cylinder stroke sensor.

Calibration Method of Distance Sensor

Figure 8:
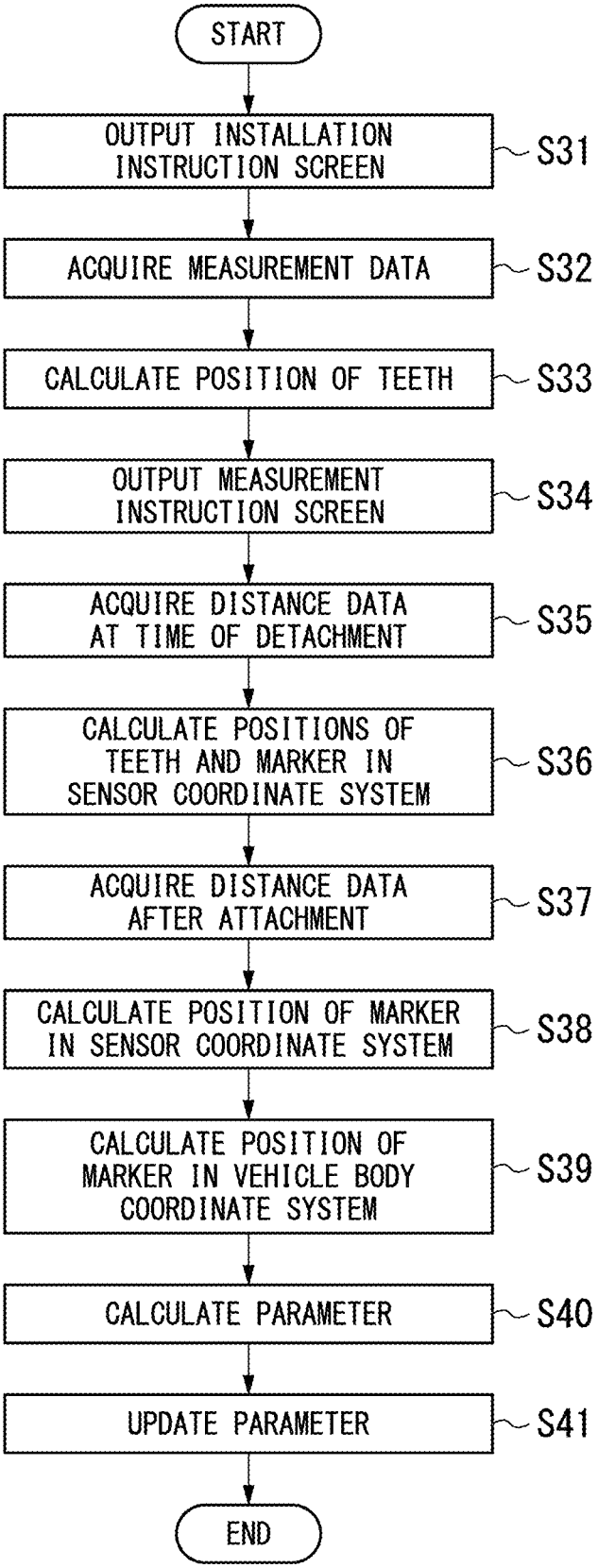
FIG. 8 is a flowchart showing the calibration method of the distance sensor of the work machine according to the second embodiment.

FIG. 8 is a flowchart showing the calibration method of the distance sensor 133 of the work machine 100 according to the second embodiment.

When the operator operates the control device 173 to activate the calibration function of the distance sensor 133, the control device 173 starts a calibration process shown in FIG. 8.

First, the display control unit 211 outputs, to the display 1731, the installation instruction screen prompting the installation of the plurality of markers M in the measurement area R of the distance sensor 133 (step S31). For example, the installation instruction screen includes the guide message, such as "Please install four markers in the measurement area of the distance sensor." In addition, the installation instruction screen may include the three-dimensional data indicating the shape of the measurement area R generated based on the measurement data of the distance sensor 133. As a result, the operator can visually recognize the installation instruction screen and determine whether or not the markers M are installed in the measurement area R.

When the operator completes the installation of the markers M, the operator operates the control device 173 and proceeds with the process.

Then, the acquisition unit 212 acquires the measurement data from various sensors (step S32). The posture-specifying unit 214 specifies the position of the teeth of the bucket 155 in the vehicle body coordinate system based on the measurement data of the boom cylinder stroke sensor 1561, the arm cylinder stroke sensor 1571, and the bucket cylinder stroke sensor 1581 acquired in step S32 (step S33).

Then, the display control unit 211 outputs, to the display 1731, a measurement instruction screen prompting the detachment of the distance sensor 133 from the work machine 100 and the measurement of the area including the plurality of markers M and the teeth of the bucket 155 by the distance sensor 133 (step S34). For example, the measurement instruction screen includes a guide message, such as "Please detach the distance sensor, measure the distances of the marker and the teeth of the bucket, and then attach the distance sensor again."

The operator detaches the distance sensor 133 from the work machine 100 and measures the area including the teeth of the bucket 155 and the plurality of markers M. The distance sensor 133 has, for example, a measurement button, and the operator may press the measurement button to perform the manual measurement by the distance sensor 133.

When the distance sensor 133 is attached to the work machine 100 by the operator, the acquisition unit 212 acquires the distance data measured while the distance sensor 133 is detached (step S35). The distance data measured when the distance sensor 133 is detached is the distance data in the area in which the teeth of the bucket 155 and the marker M are present. That is, the acquisition unit 212 is an example of a relationship acquisition unit that acquires the positional relationship between the marker M and the teeth of the bucket 155. The position calculation unit 213 specifies the positions of the teeth of the bucket 155 and the marker M in the sensor coordinate system when the distance sensor is detached, based on the measurement data acquired in step S35 (step S36).

Then, the acquisition unit 212 acquires the distance data measured after the attachment of the distance sensor 133 (step S37). The position calculation unit 213 specifies the position of the marker M in the sensor coordinate system after the distance sensor is attached, based on the measurement data acquired in step S36 (step S38).

Then, the calibration unit 215 specifies the position of each marker M in the vehicle body coordinate system based on the position of the teeth of the bucket 155 acquired in step S33, and the positions of the teeth of the bucket 155 and the markers M in the sensor coordinate system when the distance sensor is detached, which are calculated in step S36 (step S39). The calibration unit 215 can specify the position of the marker M in the vehicle body coordinate system by applying the position of the teeth in the vehicle body coordinate system to the position of the teeth of the bucket 155 and the marker M obtained in step S36.

Then, the calibration unit 215 calculates the parameters indicating the installation position and the inclination of the distance sensor 133 in the work machine 100 based on the position of the marker M in the sensor coordinate system after the distance sensor is attached, which is specified in step S38, and the position of the marker M in the vehicle body coordinate system, which is specified in step S39 (step S40). The calibration unit 215 stores the parameter calculated in step S38 in the parameter storage unit 217 (step S41).

As described above, the control device 173 according to the second embodiment calibrates the parameter of the distance sensor as follows.

The acquisition unit 212 acquires first distance data in the area in which the marker M installed at an arbitrary position outside the work machine 100 is present, the first distance data being measured by the distance sensor 133 attached to the work machine 100. Further, the acquisition unit 212 acquires, as the positional relationship between the marker M, and the teeth of the bucket 155 of which the position in the vehicle body coordinate system and the site coordinate system is known, second distance data in an area the teeth of the bucket 155 and the marker M appear, the second distance data being measured by the distance sensor 133 detached from the work machine 100. The calibration unit 215 calibrates, based on the first distance data and the second distance data, the parameter to be used to measure a position in the vehicle body coordinate system from the distance data of the distance sensor 133.

As a result, the control device 173 according to the second embodiment can calibrate the distance sensor 133 that measures the distance in the area in which the work tool 150 does not appear.

It should be noted that, according to the second embodiment, the distance data, which is measured by the distance sensor 133 detached from the work machine 100, is used as the second distance data, but another embodiment is not limited to this. For example, according to another embodiment, distance data, which is measured by an external distance sensor prepared separately from the distance sensor 133, may be used as the second distance data.

Third Embodiment

The control device 173 according to the first embodiment needs to turn the work machine 100 and to drive the work tool 150 for calibration of the distance sensor 133. On the other hand, the control device 173 according to a third embodiment calibrates the distance sensor 133 without operating the work machine 100. The control device 173 according to the third embodiment calibrates the distance sensor 133 by using the measurement data of an external distance sensor 300 provided outside. The external distance sensor 300 has a positioning function for measuring its position in the site coordinate system. The control device 173 is communicably connected to the external distance sensor 300 wirelessly or by wire. The control device 173 may be configured to acquire the data from the external distance sensor 300 via a removable medium or the like.

Figure 9:
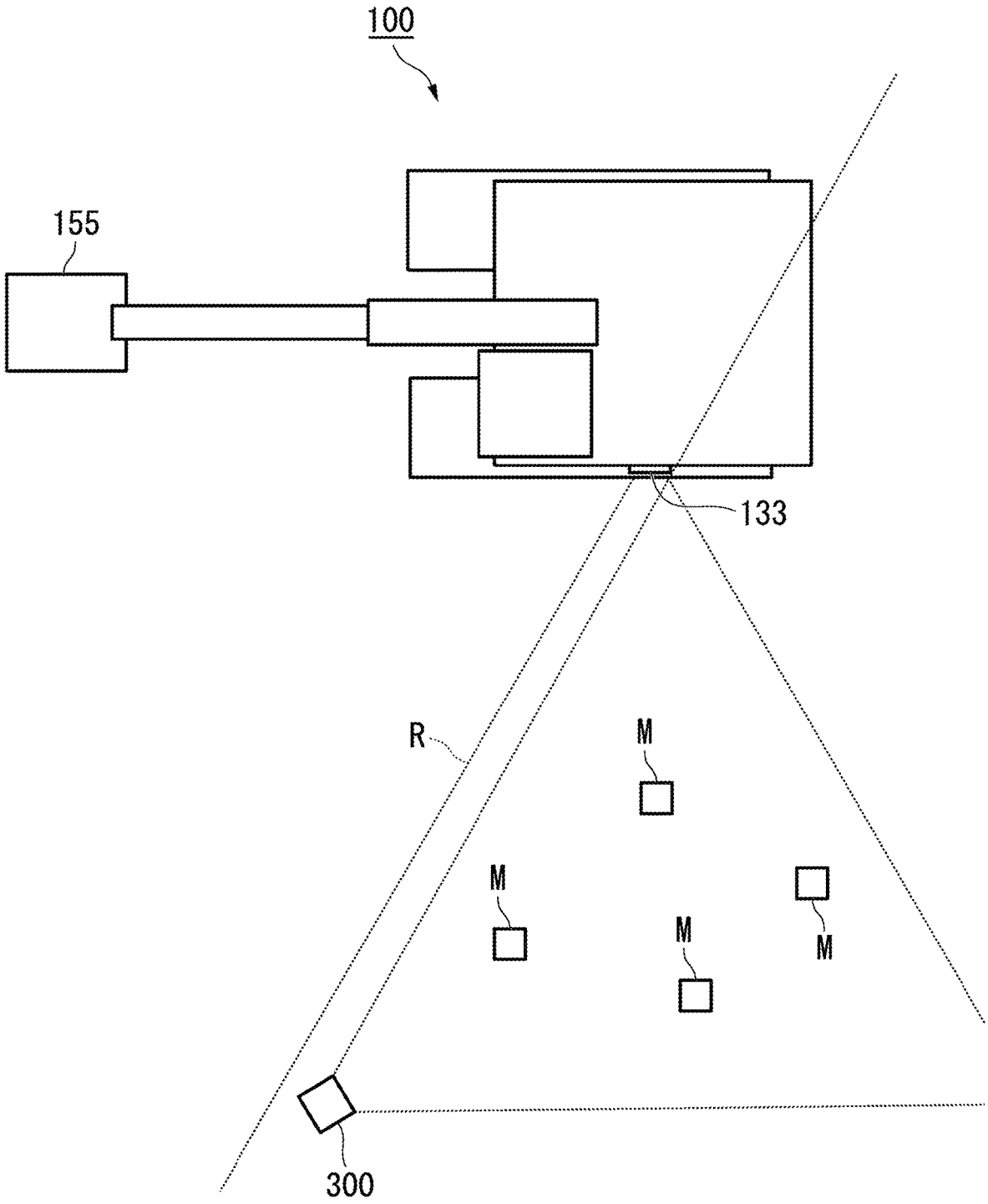
FIG. 9 is a diagram showing an outline of a calibration method of a distance sensor of a work machine according to a third embodiment.

FIG. 9 is a diagram showing an outline of a calibration method of the distance sensor 133 of the work machine 100 according to the third embodiment.

In the third embodiment, the plurality of markers M and the external distance sensor 300 are installed in the measurement area R of the distance sensor 133, and the positions of the plurality of markers M are measured by the external distance sensor 300. As a result, the control device 173 of the work machine 100 can constitute the parameter of the distance sensor 133 based on the position of the external distance sensor in the vehicle body coordinate system when the position of the marker M measured by the distance sensor 133 corresponds to the position of the marker M measured by the external distance sensor 300, and the known position of the external distance sensor in the site coordinate system.

Calibration Method of Distance Sensor

Figure 10:
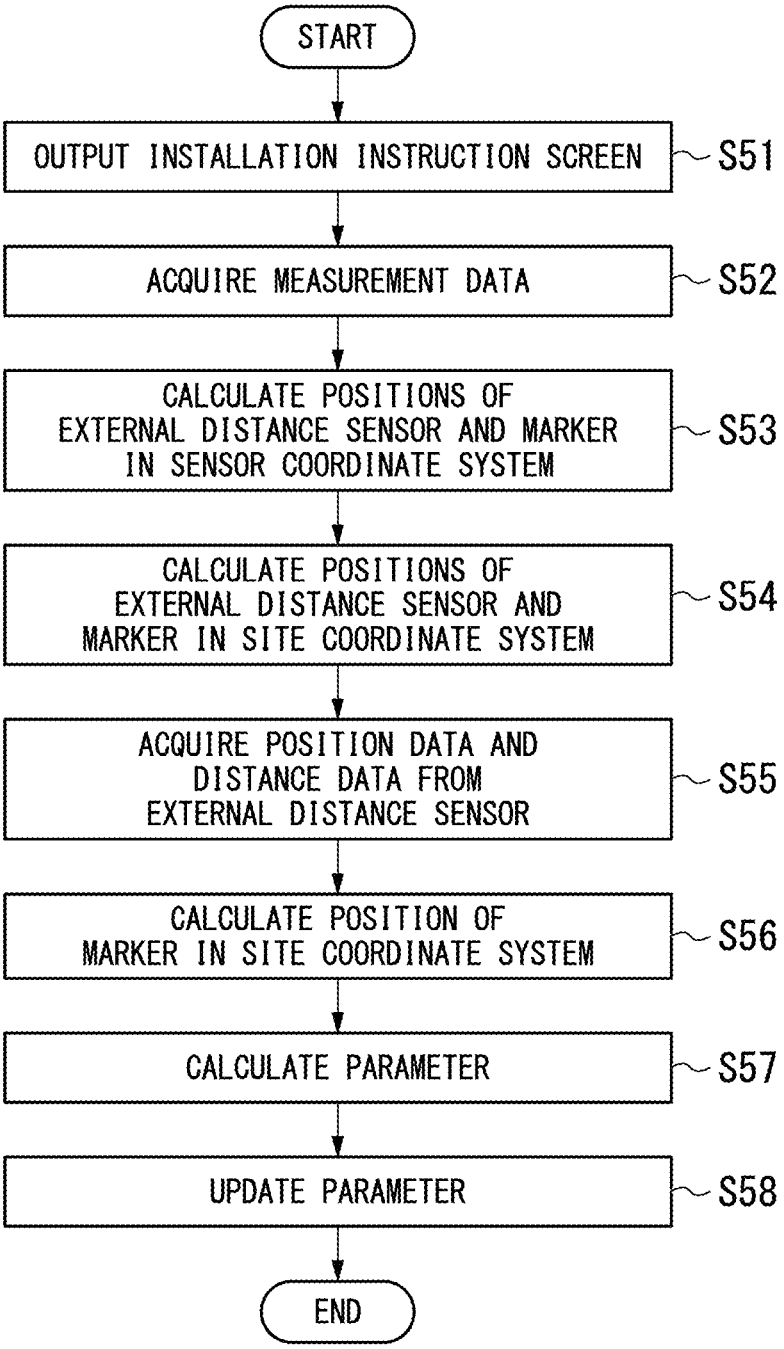
FIG. 10 is a flowchart showing the calibration method of the distance sensor of the work machine according to the third embodiment.

FIG. 10 is a flowchart showing the calibration method of the distance sensor 133 of the work machine 100 according to the third embodiment.

When the operator operates the control device 173 to activate the calibration function of the distance sensor 133, the control device 173 starts a calibration process shown in FIG. 10.

First, the display control unit 211 outputs, to the display 1731, the installation instruction screen prompting the installation of the plurality of markers M and an external measurement device in the measurement area R of the distance sensor 133 (step S51). For example, the installation instruction screen includes a guide message, such as "Please install four markers in the measurement area of the distance sensor, and then install the external distance sensor in the measurement area such that the external distance sensor can measure the four markers." In addition, the installation instruction screen may include the three-dimensional data indicating the shape of the measurement area R generated based on the measurement data of the distance sensor 133. As a result, the operator can visually recognize the installation instruction screen and determine whether or not the marker M and the external distance sensor 300 are installed in the measurement area R.

When the operator completes the installation of the markers M and the external distance sensor 300, the operator operates the control device 173 and proceeds with the process. The acquisition unit 212 acquires the measurement data from various sensors (step S52). The position calculation unit 213 specifies the positions of the markers M and the external distance sensor 300 in the sensor coordinate system based on the distance data acquired in step S52 (step S53). The coordinate transformation unit 216 transforms the positions of the marker M and the external distance sensor 300 specified in step S53 into the positions in the site coordinate system, based on the parameter stored in the parameter storage unit 217 and the measurement data of the position/azimuth direction detector 131 and the inclination detector 132 acquired in step S52 (step S54).

In addition, the acquisition unit 212 acquires the position data and the measurement data indicating the position of the external distance sensor 300 in the site coordinate system from the external distance sensor 300 (step S55).

The calibration unit 215 specifies the position of each marker M in the site coordinate system from the position data and the measurement data of the external distance sensor 300 acquired in step S55 (step S56). Then, the calibration unit 215 specifies the parameters indicating the position and the inclination of the distance sensor 133 in the work machine 100 such that a difference between the positions of the marker M and the external distance sensor 300 specified in step S54 in the site coordinate system, and the position data of the external distance sensor 300 acquired in step S55 and the position of the marker M in the site coordinate system specified in step S56 is minimized (step S57).

The calibration unit 215 stores the parameter calculated in step S57 in the parameter storage unit 217 (step S58).

As described above, the control device 173 according to the third embodiment calibrates the parameter of the distance sensor as follows.

The acquisition unit 212 acquires the first distance data in the area in which the marker M and the external distance sensor 300 installed at arbitrary positions outside the work machine 100 are present, the first distance data being measured by the distance sensor 133 attached to the work machine 100. In addition, the acquisition unit 212 acquires, as the positional relationship between the marker M, and the external distance sensor 300 of which the position in the vehicle body coordinate system and the site coordinate system is known, the second distance data in the area in which the marker M appears, the second distance data being measured by the external distance sensor 300. The calibration unit 215 calibrates, based on the first distance data and the second distance data, the parameter to be used to measure a position in the vehicle body coordinate system from the distance data of the distance sensor 133.

As a result, the control device 173 according to the third embodiment can calibrate the distance sensor 133 that measures the distance in the area in which the work tool 150 does not appear.

Another Embodiment

Although the embodiments have been described in detail with reference to the drawings, a specific configuration is not limited to the above, and various design changes and the like can be made. That is, in another embodiment, the order of the processes described above may be changed as appropriate. In addition, some processes may be performed in parallel.

For example, in another embodiment, a GNSS-real time kinematic (RTK) rover may be used to specify the positions of the plurality of markers M in the site coordinate system and to calibrate the distance sensor 133 based on the positions in the site coordinate system.

Specifically, the control device 173 according to another embodiment may calibrate the distance sensor 133 by the following procedure. The control device 173 receives the input of the position in the site coordinate system of each of three or more markers M measured by the GNSS-RTK rover. The control device 173 transforms the position of the marker M measured by the distance sensor 133 into a position in the site coordinate system based on the measurement data obtained from the position/azimuth direction detector 131 and the inclination detector 132. The control device 173 calibrates the parameter of the distance sensor 133 such that the transformed positions of the plurality of markers M correspond to the positions of the plurality of markers M specified by the GNSS-RTK rover. In addition, the control device 173 according to another embodiment may calibrate the distance sensor 133 by the following procedure. The control device 173 receives the input of the position of one marker M in the site coordinate system measured by the GNSS-RTK rover. The operator operates the work machine 100 and measures the position of the marker M by the distance sensor 133 at three or more different points at which the marker M is positioned in the measurement area R of the distance sensor 133. The control device 173 transforms the position of the marker M measured at different positions into a position in the site coordinate system based on the measurement data obtained from the position/azimuth direction detector 131 and the inclination detector 132. The control device 173 calibrates the parameter of the distance sensor 133 such that the transformed positions of the plurality of markers M correspond to the positions of the markers M specified by the GNSS-RTK rover.

The control device 173 according to the embodiments described above may be configured by a single computer, or the configuration of the control device 173 may be divided and arranged into a plurality of computers and the plurality of computers may function as the control device 173 by cooperating with each other. In this case, some of the computers constituting the control device 173 may be mounted inside the work machine 100, and others may be provided outside the work machine 100.

According to the embodiments described above, the posture of the work tool 150 is obtained based on the measurement data of the cylinder stroke sensor, but another embodiment is not limited to this. For example, in another embodiment, the posture of the work tool 150 may be specified based on the IMU attached to each of the boom 151, the arm 152, and the bucket 155, or an encoder that measures a rotation amount of each pin, instead of the cylinder stroke sensor.

What is claimed is:

1. A calibration device that calibrates an in-vehicle distance sensor provided in a work machine, the calibration device comprising:

the in-vehicle distance sensor;

a first reference object;

a second reference object;

a distance acquisition unit that acquires first distance data that is distance data in an area in which the first reference object is installed at an arbitrary position outside the work machine, the first distance data being measured by the in-vehicle distance sensor and indicating a position of the first reference object in a sensor coordinate system;

a position calculation unit that calculates a position of the first reference object in a predetermined coordinate system based on the first distance data, the predetermined coordinate system being different from the sensor coordinate system;

a relationship acquisition unit that acquires a positional relationship between the first reference object and the second reference object, a position of the second reference object in the predetermined coordinate system being known; and a calibration unit that calibrates, based on the first distance data and the positional relationship, a parameter to be used to convert a position in the sensor coordinate system detected by the in-vehicle distance sensor to a position in the predetermined coordinate system.

2. The calibration device according to claim 1, wherein the second reference object is a work tool provided in the work machine, and the positional relationship includes a position of the work tool when part of the work tool is brought into contact with the first reference object.

3. The calibration device according to claim 1, wherein the second reference object is a work tool provided in the work machine, and the positional relationship includes second distance data that is distance data in an area in which the work tool and the first reference object are present, the second distance data being measured by an external distance sensor provided outside the work machine.

4. The calibration device according to claim 3, wherein the in-vehicle distance sensor is detachably provided on the work machine, and the external distance sensor is the in-vehicle distance sensor detached from the work machine.

5. The calibration device according to claim 1, wherein the second reference object is an external distance sensor that is provided outside the work machine and that has a positioning function, and the relationship second distance data in the area in which the first reference object is present, the second distance data being measured by the external distance sensor.

6. The calibration device according to claim 5, wherein the first distance data is distance data in an area in which the external distance sensor and the first reference object are present.

7. The calibration device according to claim 1, further comprising:

a display control unit that outputs screen data to a display displaying information for an operator, the second reference object being a work tool provided in the work machine, the display control unit being configured to output, to the display, screen data including an instruction to bring part of the work tool into contact with the first reference object to make the operator institute an operation based on the instruction, and the relationship acquisition unit being configured to acquire, as the positional relationship, a position of the work tool when the part of the work tool is brought into contact with the first reference object.

8. The calibration device according to claim 1, further comprising:

a display control unit that outputs screen data to a display displaying information for an operator, the second reference object being a work tool provided in the work machine, the display control unit being configured to output, to the display, screen data including an instruction to measure an area including the work tool and the first reference object by an external distance sensor provided outside the work machine to make the operator institute an operation based on the instruction, and the relationship acquisition unit being configured to acquire, as the positional relationship, second distance data that is distance data in an area including the work tool and the first reference object, the distance data being measured by the external distance sensor.

9. The calibration device according to claim 8, wherein the in-vehicle distance sensor is detachably provided in the work machine, and the external distance sensor is the in-vehicle distance sensor detached from the work machine.

10. The calibration device according to claim 1, further comprising:

a display control unit that outputs screen data to a display displaying information for an operator, the second reference object being an external distance sensor that is provided outside the work machine and that has a positioning function, the display control unit being configured to output, to the display, screen data including an instruction to install the external distance sensor such that the in-vehicle distance sensor measures an area including the first reference object and the external distance sensor and such that the external distance sensor measures an area including the first reference object to make the operator institute an operation based on the instruction, the first distance data being distance data in an area including the first reference object and the external distance sensor, and the relationship acquisition unit being configured to acquire, as the positional relationship, second distance data that is distance data in an area including the first reference object measured by the external distance sensor.

11. The calibration device according to claim 1, wherein the in-vehicle distance sensor is provided in a position in which the second reference object does not interfere with a measurement area of the in-vehicle distance sensor.

12. The calibration device according to claim 11, wherein the in-vehicle distance sensor is provided on a side surface of the work machine.

13. A calibration method of an in-vehicle distance sensor provided in a work machine, the method comprising:

using the in-vehicle distance sensor to acquire first distance data by measuring an area in which a first reference object is installed at an arbitrary position outside the work machine, the first distance data indicating a position of the first reference object in a sensor coordinate system;

calculating, based on the first distance data, a position of the first reference object in a predetermined coordinate system different from the sensor coordinate system;

acquiring a positional relationship between the first reference object and a second reference object, a position of the second reference object in the predetermined coordinate system being known; and calibrating, based on the first distance data and the positional relationship, a parameter to be used to convert a position in the sensor coordinate system detected by the in-vehicle distance sensor to a position in the predetermined coordinate system.

* * * * *